US008434191B2

(12) United States Patent
Shorees

(10) Patent No.: US 8,434,191 B2
(45) Date of Patent: May 7, 2013

(54) BATHING APPARATUS

(76) Inventor: Lamia Shorees, Lakeside, CA (US)

( * ) Notice: Subject to any disclaimer, the term of this patent is extended or adjusted under 35 U.S.C. 154(b) by 0 days.

(21) Appl. No.: 13/542,400

(22) Filed: Jul. 5, 2012

(65) Prior Publication Data

US 2013/0007974 A1 Jan. 10, 2013

Related U.S. Application Data

(60) Provisional application No. 61/504,649, filed on Jul. 5, 2011.

(51) Int. Cl.
*A47K 7/03* (2006.01)

(52) U.S. Cl.
USPC ..... 15/222; D28/63; 601/137

(58) Field of Classification Search ..... 15/222; D28/63; 601/137, 138
See application file for complete search history.

(56) References Cited

U.S. PATENT DOCUMENTS 2,544,354 A * 3/1951 Reiter ..... 15/222
3,860,349 A 1/1975 Scott
3,959,841 A 6/1976 Horne
3,977,796 A 8/1976 Gillespie et al.
4,196,490 A 4/1980 Jonzon
D293,166 S * 12/1987 Caswell ..... D4/137
5,013,171 A * 5/1991 Almond, II ..... 401/6
5,295,280 A 3/1994 Hudson et al.
5,504,963 A 4/1996 Bynum et al.
5,509,164 A 4/1996 Weill
5,545,456 A 8/1996 Suida
5,555,591 A 9/1996 Chang
5,560,071 A 10/1996 Chang
5,736,213 A 4/1998 Meier
5,802,659 A 9/1998 Chang
5,979,006 A 11/1999 Stokes et al.
5,983,436 A 11/1999 Mason et al.
D440,355 S 4/2001 Nati
6,227,742 B1 5/2001 Corn et al.
6,849,055 B1 2/2005 Williams

* cited by examiner

*Primary Examiner* — Randall Chin
(74) *Attorney, Agent, or Firm* — Mark Wisnosky

(57) ABSTRACT

A bathing apparatus is described that comprises a loosely knitted or woven fabric bag made from a hydrophobic yarn material and includes an opening at one end to allow cleansing material, such as a bar of soap, to be inserted into and encased within the apparatus and loops woven into the ends of the apparatus that allow the user to grasp it readily.

4 Claims, 6 Drawing Sheets

BATHING APPARATUS

RELATED APPLICATIONS

This application claims priority to U.S. Provisional application 61/504,649 filed Jul. 5, 2011, titled Bathing Apparatus, by the same inventor.

TECHNICAL FIELD

The present invention relates to an apparatus to assist in washing a person's body, in particular to assist in washing one's back, enabling a user to reach otherwise inaccessible areas of the back, and particularly benefiting users having a limited range of motion.

RELATED BACKGROUND ART

Devices that assist an individual user in washing his/her back are known in the art. Prior devices, although beneficial to the handicapped and obese who have difficulty reaching all areas of the back, have shortcomings that cause them to be difficult to clean and nearly impossible to sterilize. These devices are largely constructed using water absorbent materials such as terry cloth and sponge which, because of the tightness of the weave or their natural configuration, inherently provide sheltered spaces where dirt and germs can become trapped. These prior devices dry very slowly allowing for the growth of mold and bacteria, and they are very difficult to clean thoroughly after use.

The present invention solves the problem associated with cleaning these prior devices by choosing the materials and configuration of the device to promote the desired thorough cleaning.

DISCLOSURE OF THE INVENTION

One embodiment of the present invention is a bathing apparatus comprising a loosely knitted or woven fabric made from a hydrophobic yarn material. The openness of the weave ensures that soap, dead skin cells, mold spores and bacteria are not trapped and are easily released by thorough rinsing after use. The use of hydrophobic yarn material assures that water drains quickly from the apparatus and that it dries thoroughly before mold or bacteria have an opportunity to grow. In another embodiment, the apparatus is woven in two pieces that are later joined, or is circularly woven with an opening at one end to allow cleansing material, such as a bar of soap, to be inserted into and encased within the apparatus, thus providing a means of directly introducing a cleansing lather into the bathing process. In yet another embodiment, the woven apparatus includes loops woven into the ends of the apparatus that allow the user to grasp it readily.

DETAILED DESCRIPTION

Figure 1:
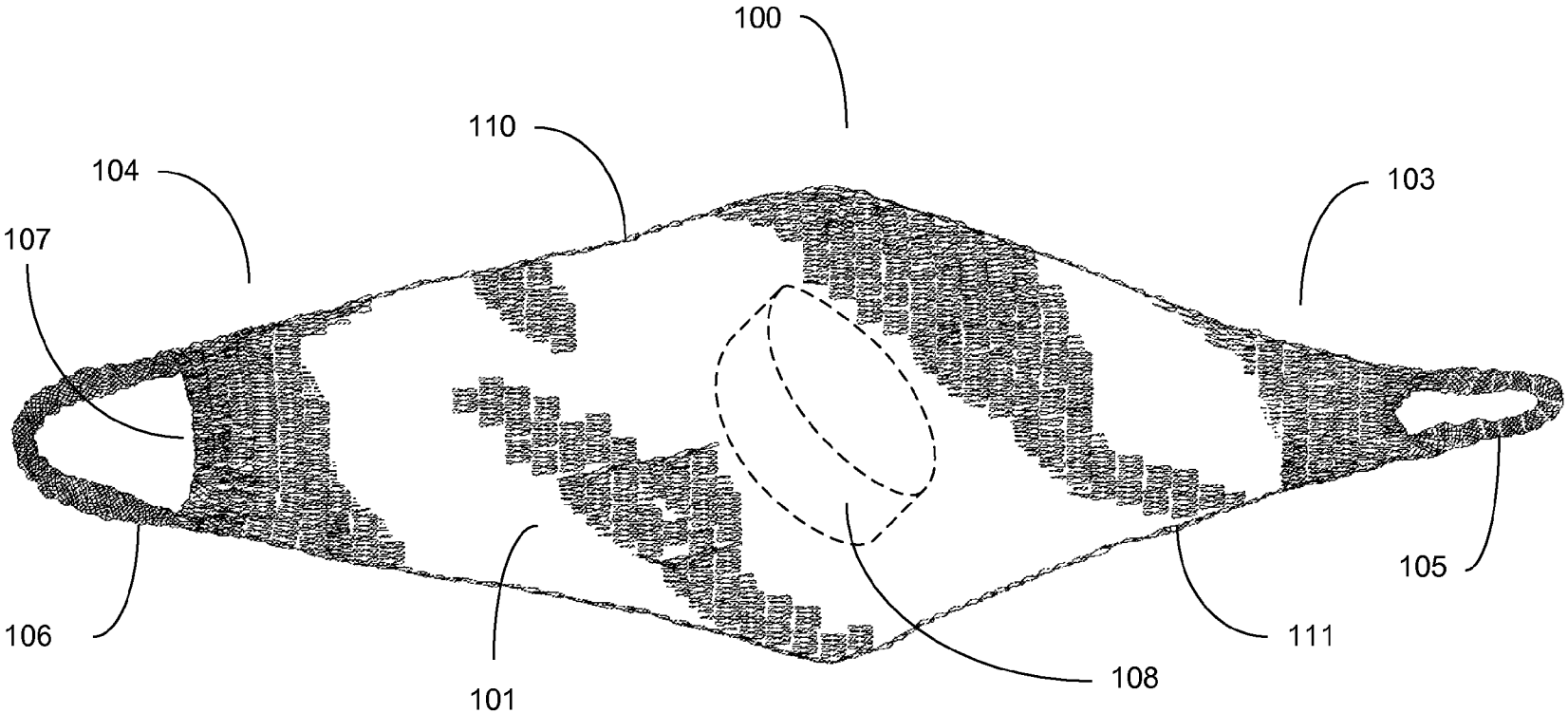
FIG. 1 is a front view of a bathing apparatus.

Referring now to the front view in FIG. 1, there is seen a bathing apparatus 100 in the form of a knitted or woven bag having a front surface sheet 101 and a separate rear surface sheet 102 joined along top edge 110 and bottom edge 111 and including a right side 103 and a left side 104 to which are attached wovenly integrated handle loops 105 and 106, respectively. In one use the elongated diamond shape of apparatus 100 is good for scrubbing the back of a user like other elongated luffa type products. In another use the elongated diamond shape makes it useful as a washcloth for scrubbing other areas of the body. Thus, the elongated diamond shape enables two uses of the apparatus, as well as helping to maintain a uniform skin contact width when the apparatus is stretched in use on an axis running between handle loops 105 and 106, which are integrated into the weave of the apparatus and thus do not require the attachment of separate handles as used in prior art devices. The integrated handle loops 105 and 106 allow the apparatus to be hung for better drainage to ensure thorough drying between uses. The use of separate handles such as metal rings or sewn on attachments in prior devices do not allow for a robust and useful apparatus since they preclude cleaning in a conventional washer and dryer after extended use and interfere with the use of the apparatus as a washcloth in scrubbing other areas of the body.

Left side 104 includes an enlarged opening 107 to the interior between the front surface sheet 101 and rear surface sheet 102 through which a bar of soap 108 may be placed within the apparatus.

Figure 2:
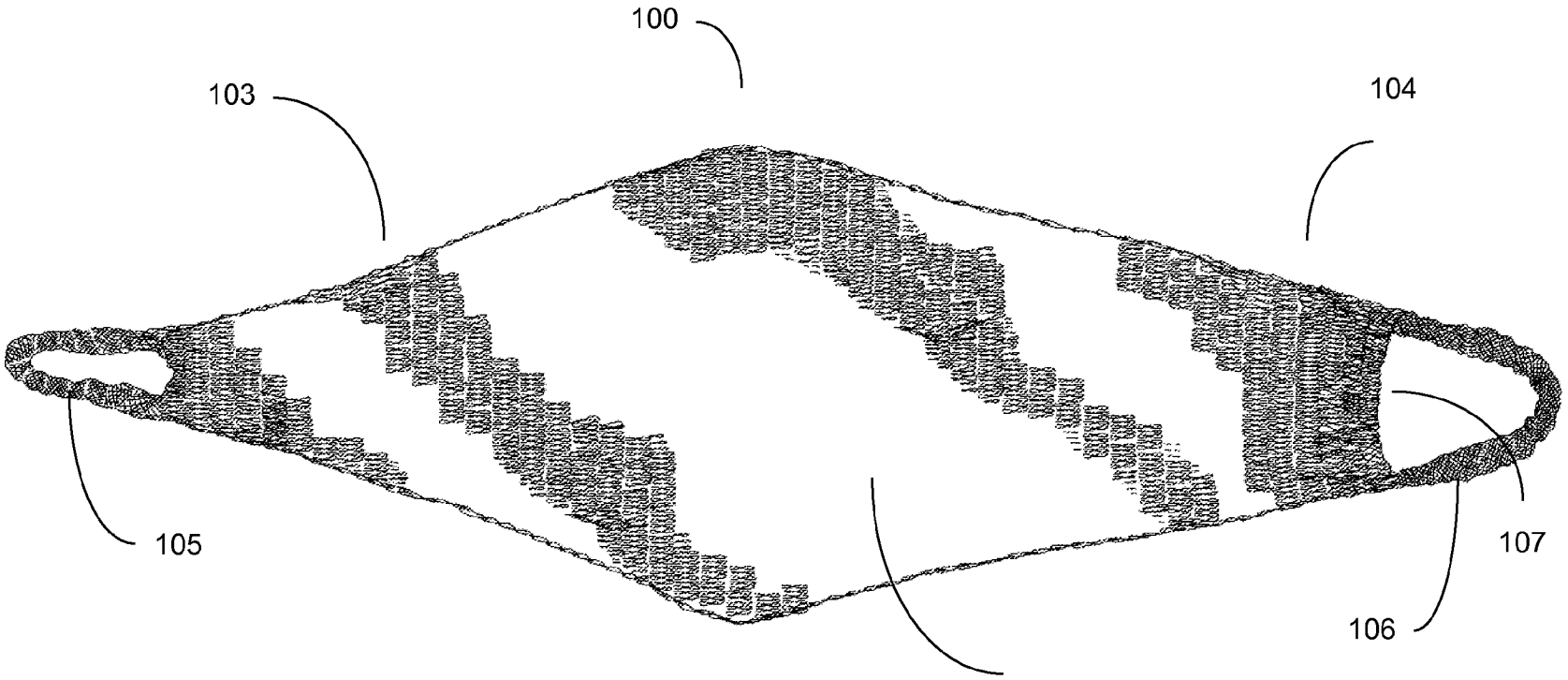
FIG. 2 is a back view of the embodiment shown in FIG. 1.
Figure 3:
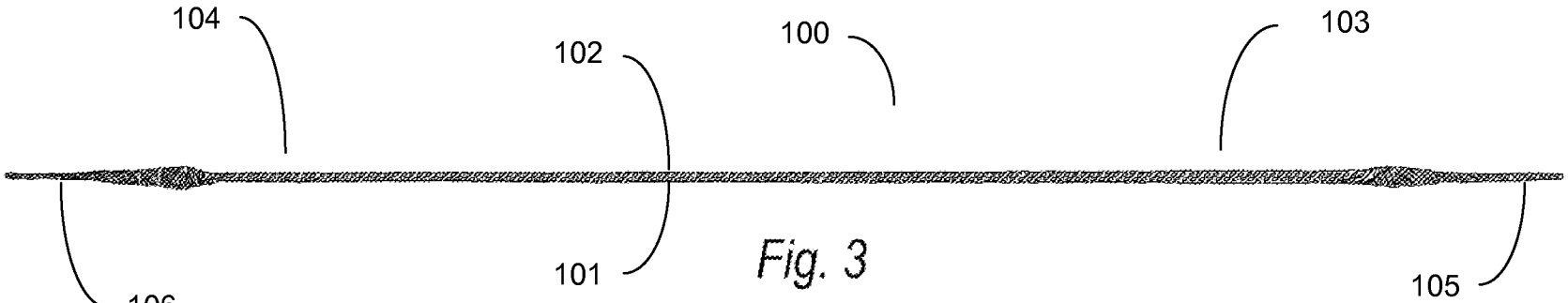
FIG. 3 is a top view of the embodiment shown in FIG. 1.
Figure 4:
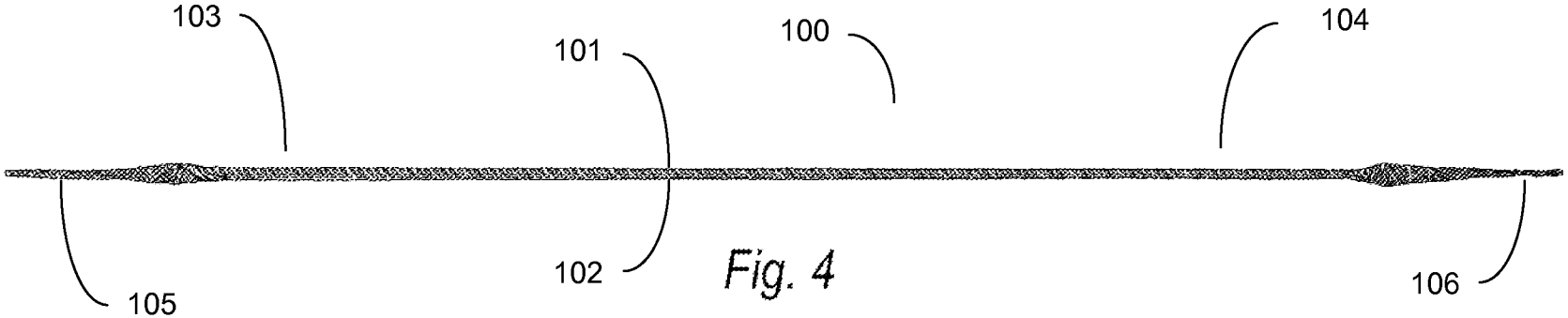
FIG. 4 is a bottom view of the embodiment shown in FIG. 1.
Figure 6:
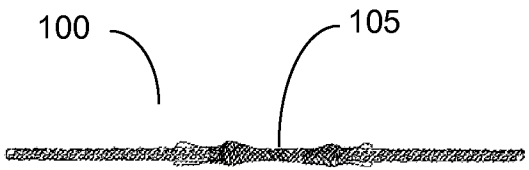
FIG. 6 is a right side view of the embodiment shown in FIG. 1.
Figure 5:
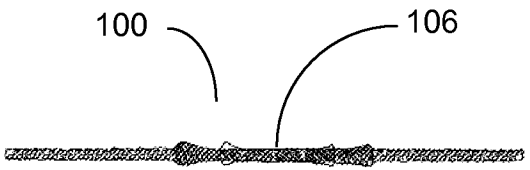
FIG. 5 is a left side view of the embodiment shown in FIG. 1.

FIG. 2 is a rear view of the bathing apparatus 100 that shows the separate rear surface sheet 102. Bathing apparatus 100 is fabricated from a loosely knitted or woven fabric made from a hydrophobic yarn material such as polyethylene or polypropylene. The form of the yarn affects the abrasiveness of the apparatus, with ribbon-like yarn producing an abrasive apparatus and yarn having elliptical or circular cross sections producing a less abrasive apparatus. In a preferred embodiment the apparatus 100 is woven with a density in the range of 10 to 100 threads or yarn elements per centimeter. The lower density weaves produce a coarse fabric that functions best as a luffa and promotes better drainage for thorough cleaning and drying between uses, while the higher density weaves produce a finer fabric that promotes lathering.

Figure 7:
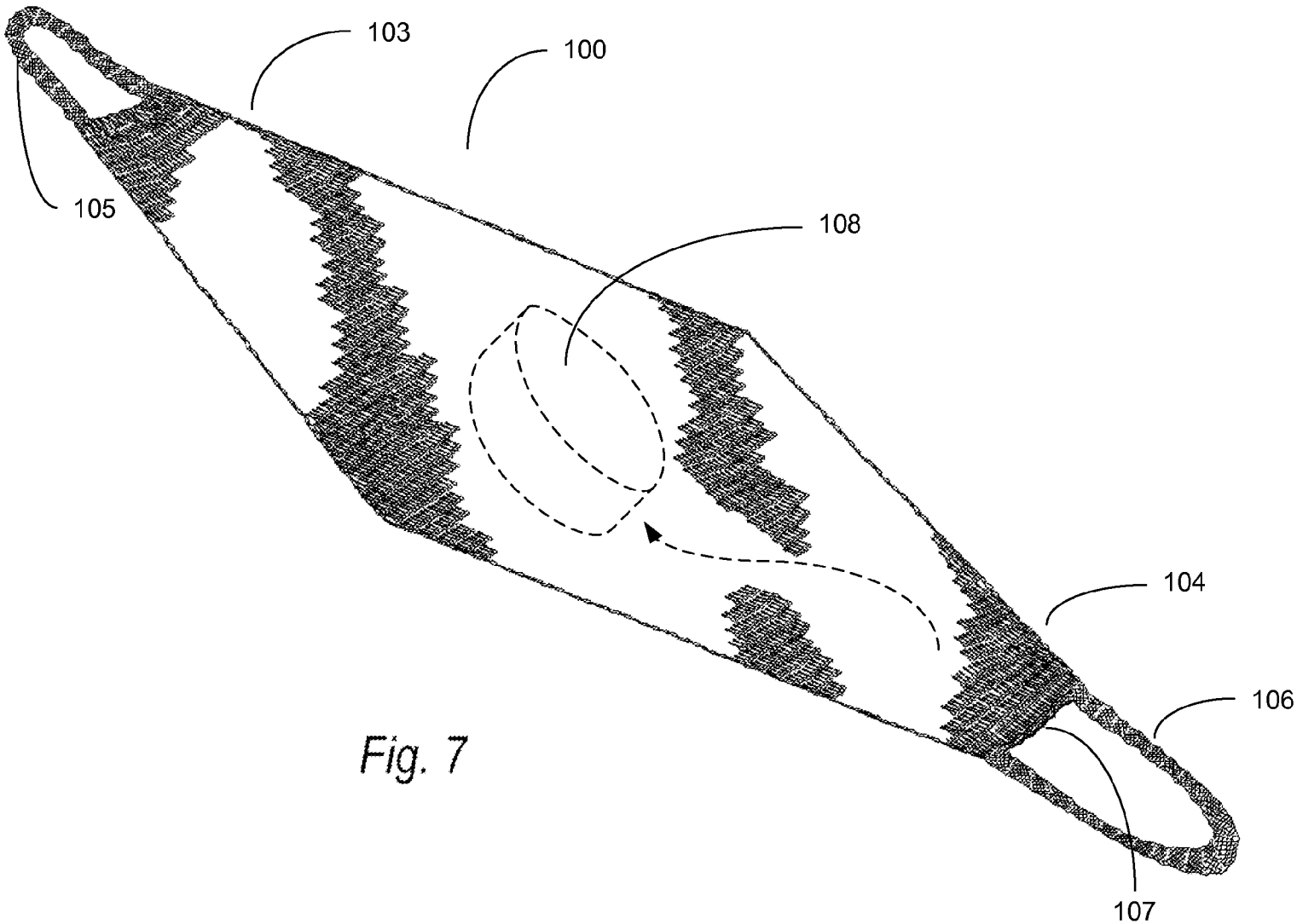
FIG. 7 is a perspective drawing of the embodiment of FIG. 1 showing the front view.
Figure 8:
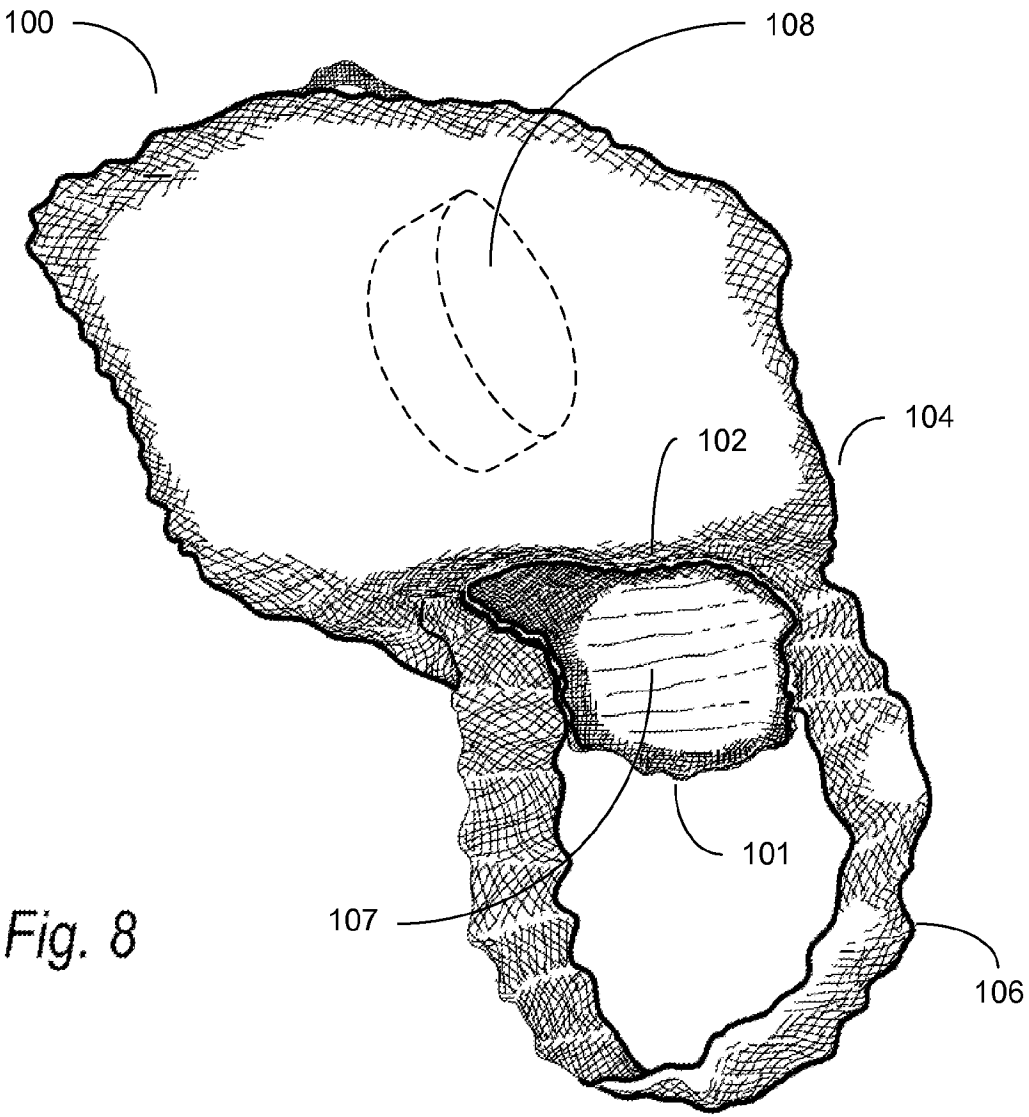
FIG. 8 is a perspective drawing of the embodiment of FIG. 1 showing the left side view

FIGS. 3-6 show side views of apparatus 100 and serve to illustrate the thinness of the woven sheets 101 and 102. FIG. 7 shows a perspective view of the apparatus and shows the placement of the soap bar 108 introduced at left side opening 107. This left side is 104 is shown in more detail in FIG. 8 which more clearly shows opening 107 between sheets 101 and 102 through which the soap bar 108 may be introduced into the interior of apparatus 100.

Figure 9:
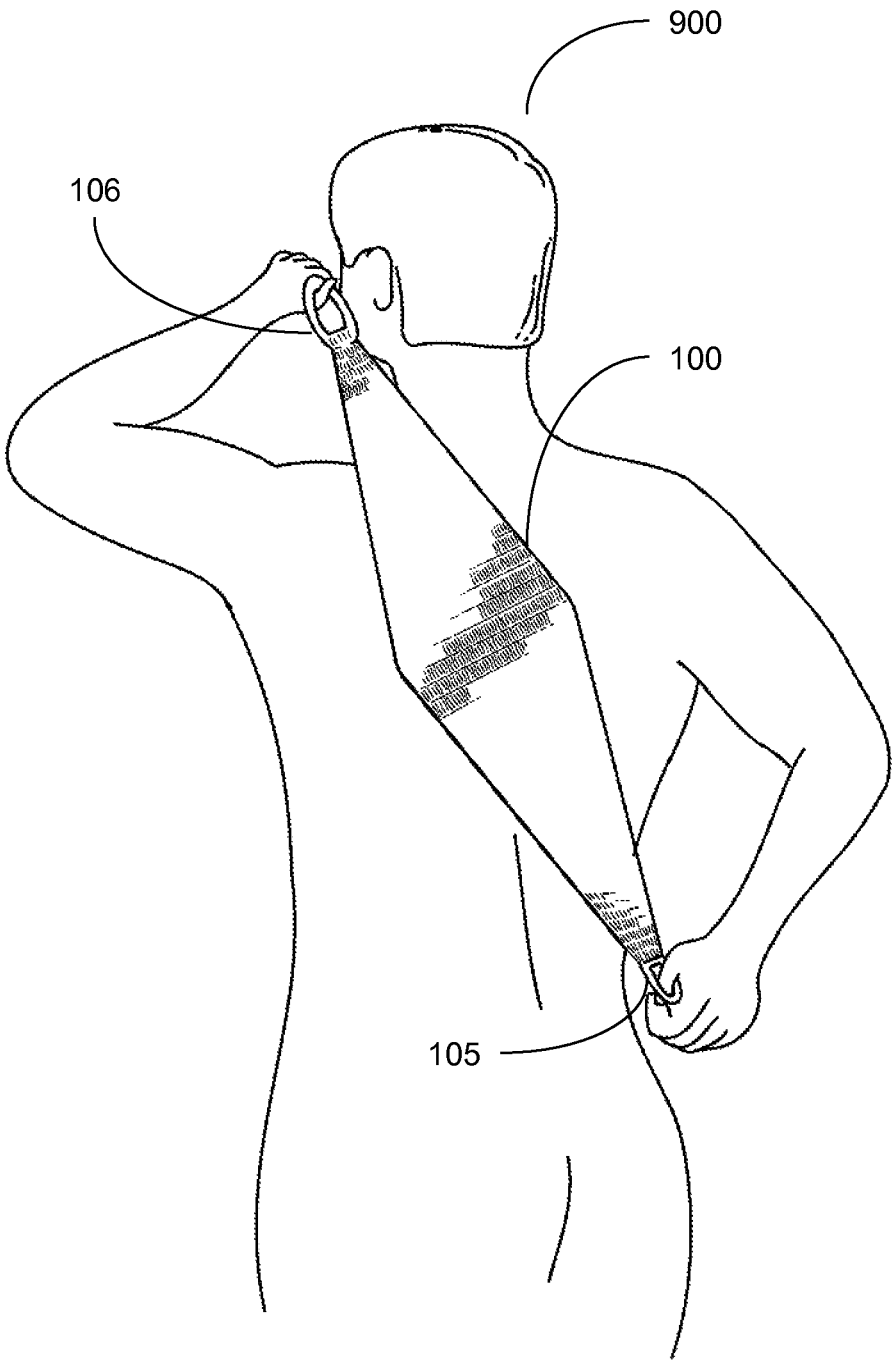
FIG. 9 is a pictorial showing the use of the embodiment of FIG. 1.

FIG. 9 shows the apparatus 100 in use by a user 900 who grasps the apparatus by the handle loops 105 and 106 in order to perform the back scrubbing function.

What is claimed is:

1. A bathing apparatus comprising:

a. a woven or knitted flattened bag having the shape of an elongated diamond, b. said bag having wovenly integrated handle loops at each of its elongated ends, c. wherein one of the elongated ends includes an opening that allows communications with the interior of the bag d. wherein said bag is woven or knitted from a hydrophobic material.

2. The bathing apparatus of claim 1 wherein the hydrophobic material comprises polyethylene.

3. The bathing apparatus of claim 1 wherein the hydrophobic material comprises polypropylene.

4. The bathing apparatus of claim 1 wherein the density of the woven or knitted fabric is in the range from 10 to 100 threads per centimeter.

* * * * *